US005481772A

United States Patent [19]

Glynn et al.

[11] Patent Number: 5,481,772

[45] Date of Patent: Jan. 9, 1996

[54] BED RAIL APPARATUS

[76] Inventors: William D. Glynn, 521 Babbs Rd., West Suffield, Conn. 06093; Kathleen E. Monahan, 415 Spruce Dr., Exton, Pa. 19341

[21] Appl. No.: 217,361

[22] Filed: Mar. 24, 1994

[51] Int. Cl.[6] ..... A47C 21/08

[52] U.S. Cl. ..... 5/663

[58] Field of Search ..... 5/663, 425, 427, 5/658, 424

[56] References Cited

U.S. PATENT DOCUMENTS

| | | | |
|---|---|---|---|
| 136,097 | 2/1873 | Roll | 5/427 |
| 1,938,635 | 1/1932 | North | 160/290.1 |
| 2,555,228 | 2/1948 | Evers | 160/369 |
| 3,742,530 | 7/1973 | Clark | 5/425 |
| 4,215,446 | 8/1980 | Mahoney | 5/425 |
| 4,232,415 | 11/1980 | Webber | 5/427 |
| 4,370,765 | 2/1983 | Webber | 5/663 |
| 4,827,545 | 5/1989 | Arp | 5/663 |
| 4,833,743 | 5/1989 | Howell et al. | 5/426 |
| 5,044,025 | 9/1991 | Hunsinger et al. | 5/425 |
| 5,175,897 | 1/1993 | Marra, Jr. | 5/663 |

FOREIGN PATENT DOCUMENTS

| | | |
|---|---|---|
| 190649 | 7/1957 | Austria . |
| 242346 | 1/1912 | Germany . |
| 3434955C1 | 3/1986 | Germany . |
| 2136289 | 9/1984 | United Kingdom . |

*Primary Examiner*—Alexander Grosz
*Attorney, Agent, or Firm*—Chilton, Alix & Van Kirk

[57] ABSTRACT

A bed rail cover for removable placement over a bed side rail comprises two spaced, opposed side panels joined along their side and top edges to a border strip, the panels and border strip being composed of an elastomeric material. A flap of elastomeric material attaches the cover to the bed, preventing bed occupants from placing their appendages through the gap between the mattress and the rail. Use of elastomeric material allows the cover to accommodate changes in the relative positions of the mattress and rails and between rail segments when the mattress position is adjusted.

12 Claims, 6 Drawing Sheets

BED RAIL APPARATUS

BACKGROUND OF THE INVENTION

The present invention relates to beds having side rails. More particularly, the invention relates to an apparatus for bed side rails which prevents injuries to bed occupants by preventing them from placing their extremities between components of the bed rail.

Hospital type beds usually have provisions for vertically movable side rails. Such side rails provide for patient control while facilitating activities such as removing and replacing bed sheets and mattresses and moving patients. When the side rails are raised and set in their normal working position, the lowermost side rails of even the best beds are in a horizontal position at or just above the upper plane of the mattress.

It is well known that bed occupants or patients who are asleep, or who cannot control or do not realize the significance of their movements, often injure themselves when their appendages become lodged between components of the bed side rails, or more commonly between a bed side rail and mattress or mattress support. Various designs have been advanced to remove this source of patient injury.

U.S. Pat. No. 4,370,765 describes an envelope for a bed having side rails. The envelop comprises an envelope portion for enveloping a side rail running the length of the bed and a flap positionable between and attachable to a mattress and mattress support. The envelope portions are made of durable and washable meshed, netted or screen-like plastic or polymeric material such as nylon. The flap is made of washable cotton sheet or canvas material.

Another approach, represented by U.S. Pat. No. 4,827,545, employs a protective covering assembly comprised of pipe insulation cut and fitted around the side rail members and a protective cover portion for enveloping a side rail running the length of the bed. The protective cover is made of a plastic upholstery.

The patents mentioned above, as well as others disclose a variety of techniques and structures for preventing patient bed injuries. However, such techniques and structures are not suitable for many hospital type beds.

Modern hospital type beds generally allow adjustment of the mattress over a range of segmental elevational configurations. Movement of the mattress changes its position relative to the bed side rails. Additionally, the bed rails on many modern hospital type beds typically employ a number of independently positionable bed rail segments which are arrayed down each side of the bed. Movement of the mattress support changes the position of the bed rail segments relative to each other.

SUMMARY OF THE INVENTION

The present invention overcomes the above briefly discussed and other deficiencies of the prior art by providing a novel bed rail apparatus which is sufficiently flexible to accommodate variable relative positions between the bed rail and the mattress and between bed rail segments. A bed rail apparatus in accordance with the present invention is characterized by ease of application and removal from the bed.

A bed rail apparatus in accordance with the invention is an envelope .like assembly comprised of spaced opposed substantially rectangular side panels attached along their top and side edges to opposing side edges of a border strip. The side panels and border strip are made from elastomeric material, for example, control mesh or power net. An additional border strip may be attached along each side panel bottom edge to provide additional strength.

The envelope assembly is open along the bottom edge such that it may be slipped over a bed rail. The elastomeric material may be stretched to envelop padding material disposed around the bed rail. A foot flap composed of elastomeric material is provided for attaching the cover to the mattress support. For single rail bed embodiments, the flap is attached to the top edge of the rail cover. For multiple rail bed embodiments, the bottom edges of the side panels are joined by the foot flap where the side rail gaps occur. The flap carries grommets which are typically attached to the mattress support by carabiner clips or similar means.

An object of the invention is to provide a new and improved bed rail apparatus for use on beds having side rails.

Another object of the invention is to provide a new and improved bed rail apparatus that is sufficiently flexible to accommodate variable relative positions between the bed rail and the mattress or between bed rail segments.

A further object of the invention is to provide a new and improved bed rail apparatus that is sufficiently flexible to accommodate the additional bulk of padding material disposed around bed rail segments.

A yet further object of the invention is to provide a new and improved bed rail apparatus that is easily installed and removed from the bed.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENT

Figure 1:
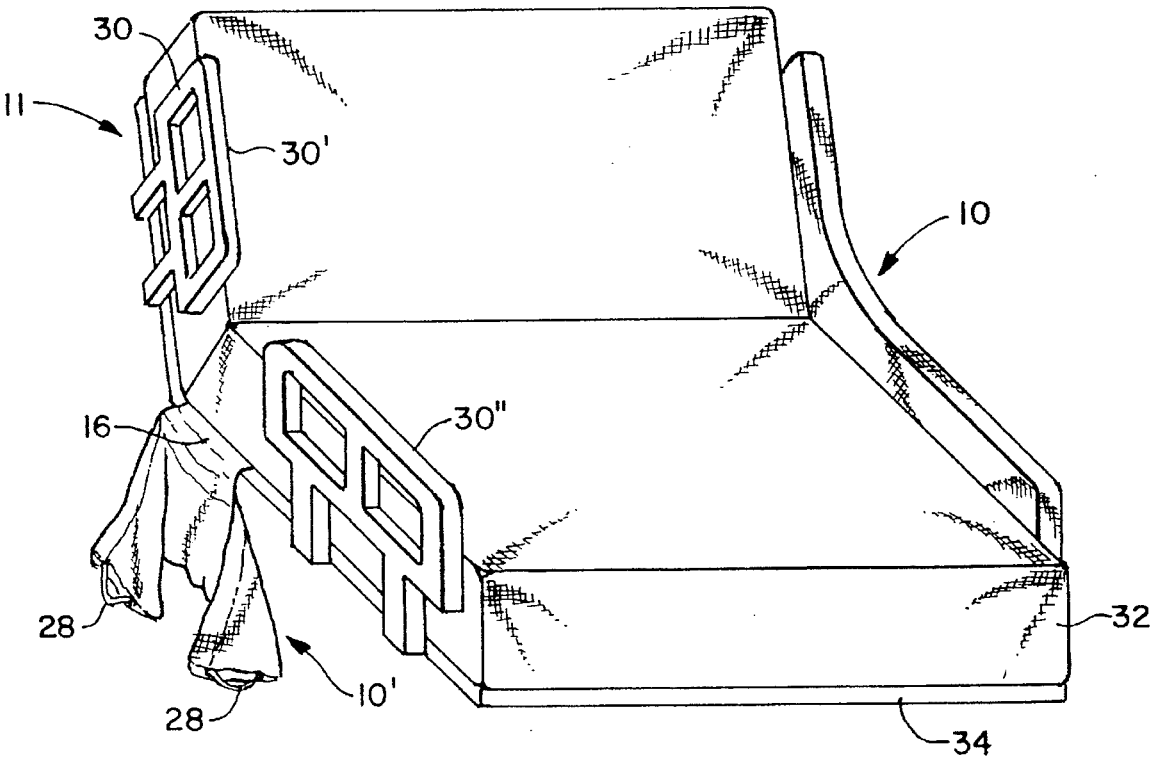
FIG. 1 is a perspective view of a hospital bed having two side rail segments on each side and having one rail apparatus in accordance with the invention fully installed and one rail apparatus partially installed.

With reference to the drawings wherein like numerals represent like parts throughout the figures, a bed rail apparatus in accordance with the present invention is generally designated with the numeral 10. The bed rail apparatus 10 is particularly adapted for a hospital bed 11 of a type having a mattress 32, a mattress support 34, bed support means (not shown) and at least one bed rail 30 on each side. The bed rail 30 typically consists of a plurality of elongate, intersecting tubular members that are adapted to move up and down relative to the bed. Each bed rail 30 may be composed of a plurality of bed rail segments 30', 30". The hospital bed has means (not shown) for adjusting the mattress 32 over a range of segmental elevational configurations. The mattress 32 is typically relatively stiff and does not conform exactly to the configuration assumed by the mattress support 34 resulting in relative movement between the mattress 32 and the bed rail 30. Additionally, movement of the mattress support 34 changes the position of the bed rail segments 30', 30" relative to each other.

The rail apparatus 10 comprises a folded resilient sheet 12 joined along the lateral end edges to define an envelope having an open bottom. The rail apparatus 10 is pulled over the bed rail 30 and secured in place by means that are described below. The resilient sheet 12 is composed of a fire retardant elastomeric material containing Lycra™ material or similar elastic fiber. The resilient sheet 12 may be divided into a pair of opposed side panels 13, 13' which are joined at their top portions 18, 18' and their end portions 15, 15'.

Figure 3:
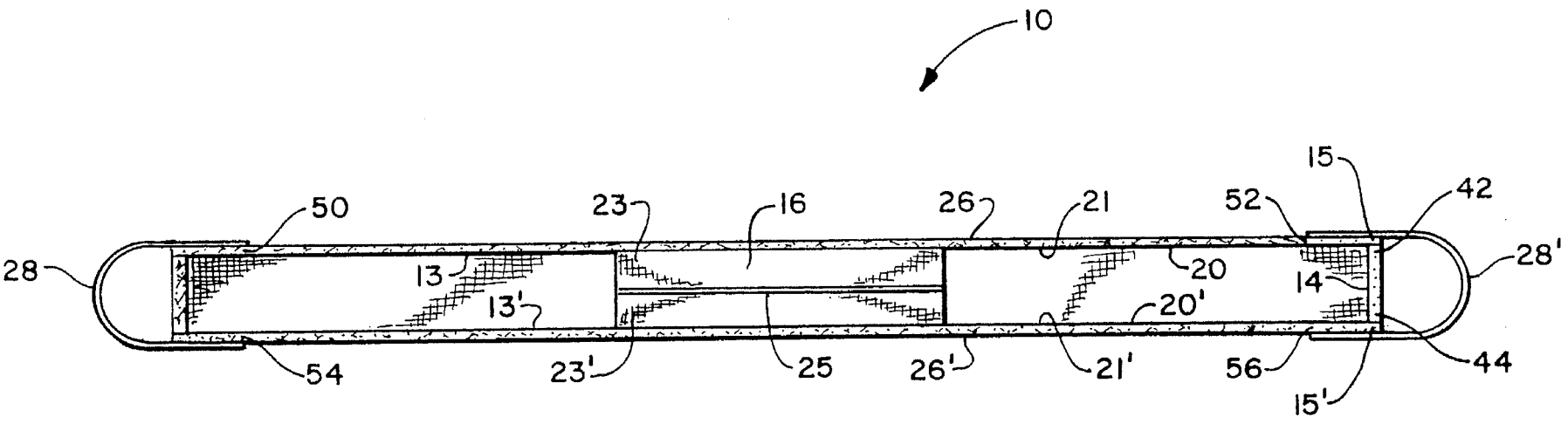
FIG. 3 is a bottom view of the bed rail apparatus of FIG. 2.
Figure 4:
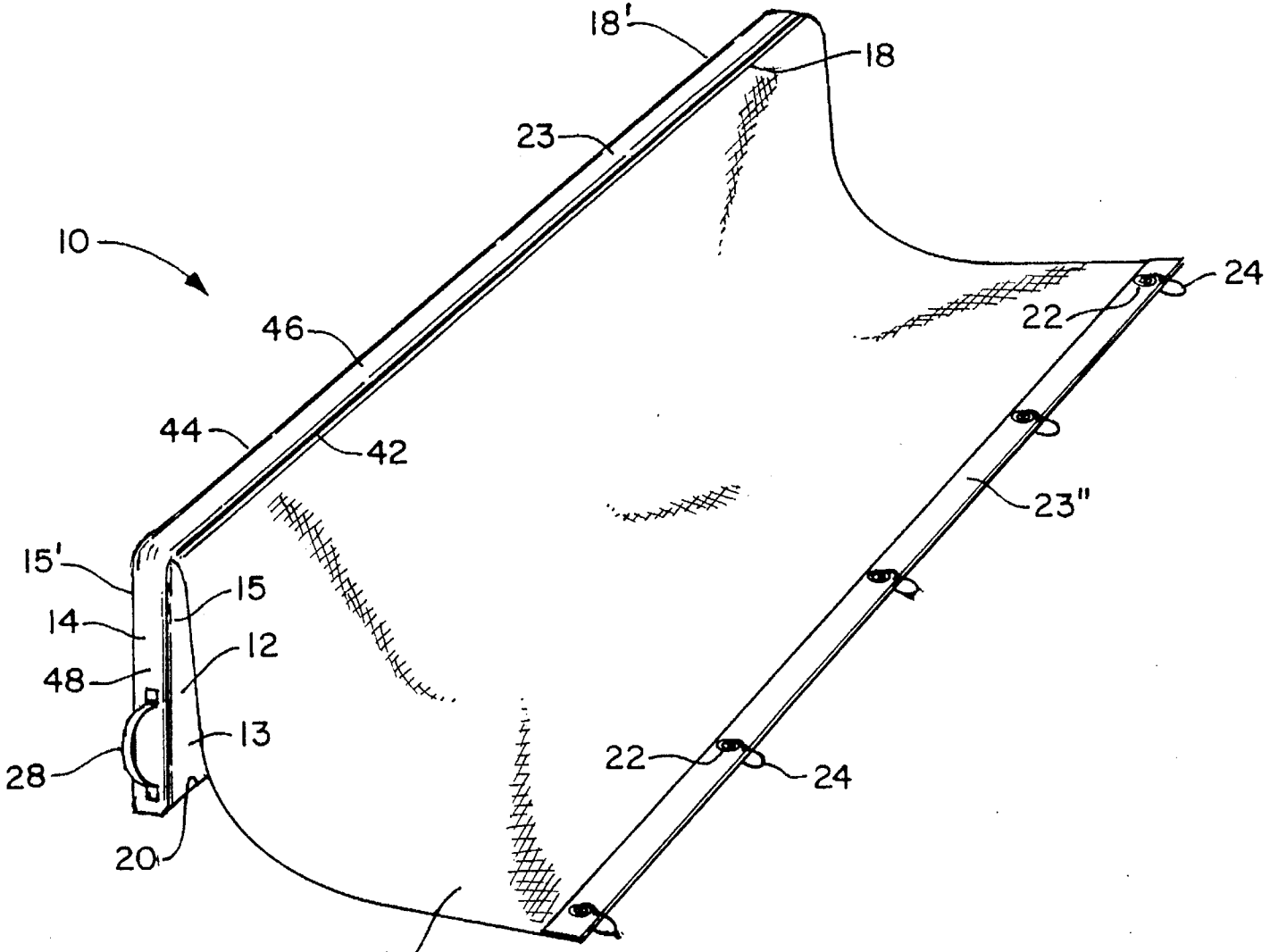
FIG. 4 is a perspective view of a bed rail apparatus, for a bed having one side rail per side, in accordance with the present invention.

In the embodiment shown in FIGS. 3 and 4, the first and second side panels 13, 13' are joined by a border strip 14. The border strip 14 is composed of a heavier grade elastomeric material, for example elastic webbing and comprises longitudinally extending first and second side edge portions 42, 44. The first edge portion 42 of the first border strip 14 is attached to the top portion 18 and the first and second end portions 15 of the first side panel 13 and the second edge portion 44 of the first border strip 14 is attached to the top portion 18' and the first and second end portions 15' of the second side panel 13', the border strip 14 thereby defines top and end portions 46, 48.

A foot flap 16 functions as a barrier to prevent the bed occupant from sticking an arm or leg through the space between the mattress 32 and the bed rail 30. In an embodiment for beds having single side rails on each side, a first edge portion 23 of the foot flap 16' is attached to one of the side panel top edges 18, as shown in FIG. 4. Grommets 22 are mounted adjacent the second edge portion 23" of the foot flap 16'. Carabiner clips 24 or similar means, engage through the grommets 22 to the mattress support 34.

Figure 2:
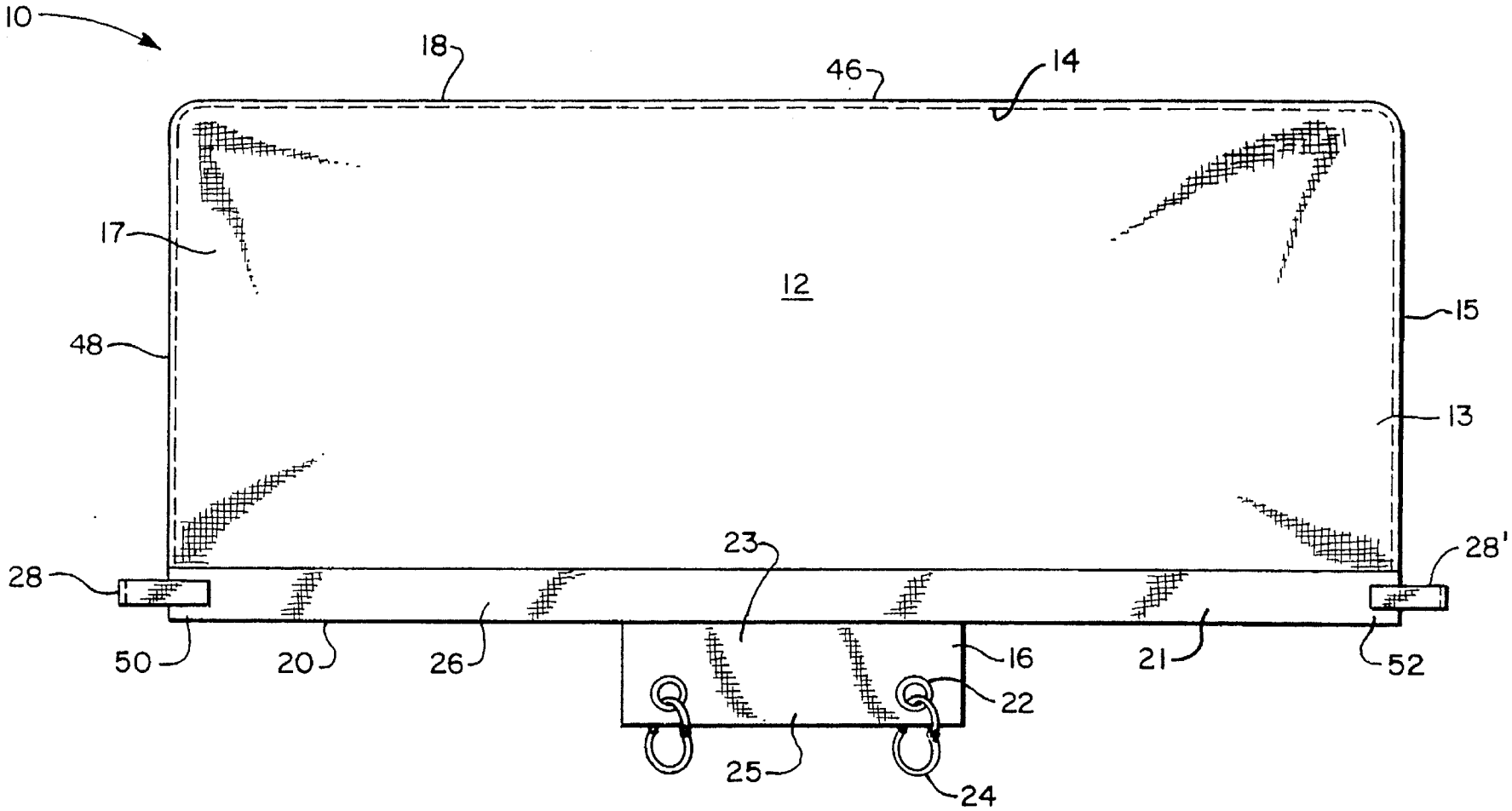
FIG. 2 is a side view, suspended for illustration purposes, of a bed rail apparatus, for a bed having two side rail segments on each side, in accordance with the present invention.

In an embodiment for beds having multiple side rails 30, 30' on each side of the bed, the foot flap 16 is connected to the bottom edges 20 of the first side panel 13 and the bottom edge 20' of the second side panel 13' where the side rail gap occurs, as shown in FIGS. 1, 2 and 3. Grommets 22 are mounted adjacent the foot flap border portion 25. Carabiner clips 24 or similar means, engage through the grommets 22 to the mattress support 34.

Figure 6:
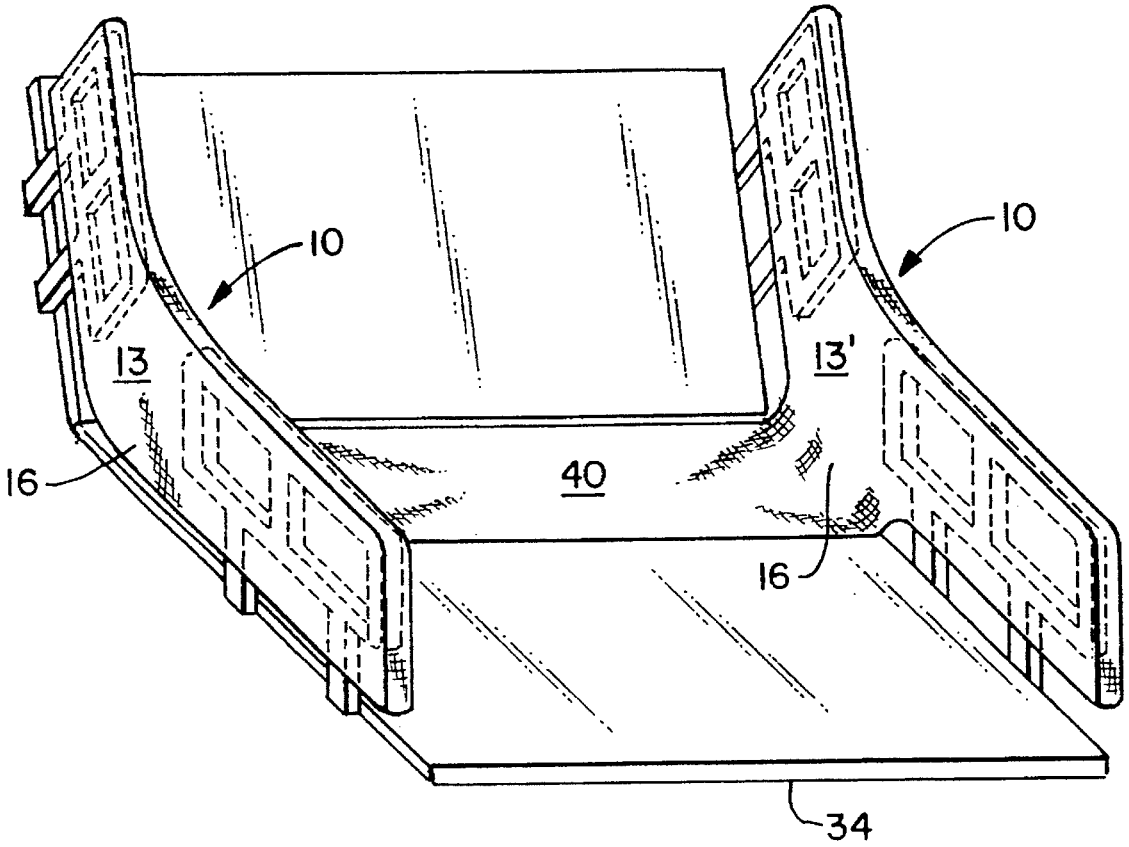
FIG. 6 is a perspective view of a hospital bed with the mattress removed and having bed rail apparatus in accordance with the present invention.

In an alternative embodiment, the foot flap 16 of one bed rail apparatus 10 may be connected to the foot flap 16 of another bed rail apparatus 10 by a sheet of resilient material 40, as shown in FIG. 6. The sheet is disposed between the mattress 32 and mattress support 34.

Bottom border strips 28, 26' may be attached along each side panel bottom edge portion 21, 21'. Handles 28 may be attached at the end portions 48 of the border strip 14, as shown in FIG. 4. Alternatively, the handles 28, 28' may be attached to the first end section 50 of the first border strip 26 to the first end section 54 of the second border strip 26' and from the second end section 52 of the first border strip 26 to the second end section 56 of the second border strip 26', as shown in FIGS. 2 and 3. Single handles 28 may also be used. The handles 28 facilitate installation and removal of the bed rail apparatus 10 by providing a means for gripping and stretching the apparatus.

The bed rail apparatus 10 is open along the bottom edge 20, 20' such that a bed rail apparatus 10 may be slipped over the bed rail 30, as shown in FIG. 1. A foot flap 16 is attached to The mattress support to prevent patients from inadvertently sticking an appendage through the gap between the bed rail 30 and the mattress 32. Use of elastomeric material allows the apparatus 10 to stretch and accommodate relative movement between the mattress 32 and the rail 30 and between the bed rail segments 30', 30" when the mattress position is adjusted. Additionally, the use of elastomeric material allows the apparatus 10 to stretch and envelop padding material disposed around bed rail components and pillows or other padding material disposed between bed rail components. Triple interlocking stitches are utilized to join border strips 14, 26, 26' to the side panels 13, 13'. These stitches provide strength while allowing stretching of the joined border strips 14, 26, 26' and side panels 13, 13'.

Figure 5A:
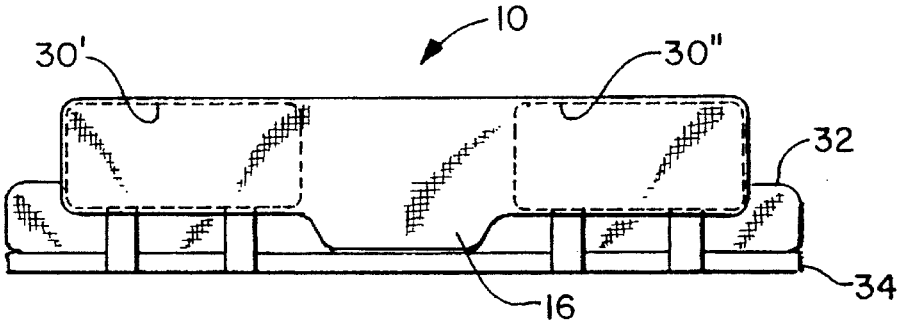
FIGS. 5A, 5B and 5C are side views of three alternative mattress configurations for a hospital bed having a bed rail apparatus in accordance with the present invention.
Figure 5B:
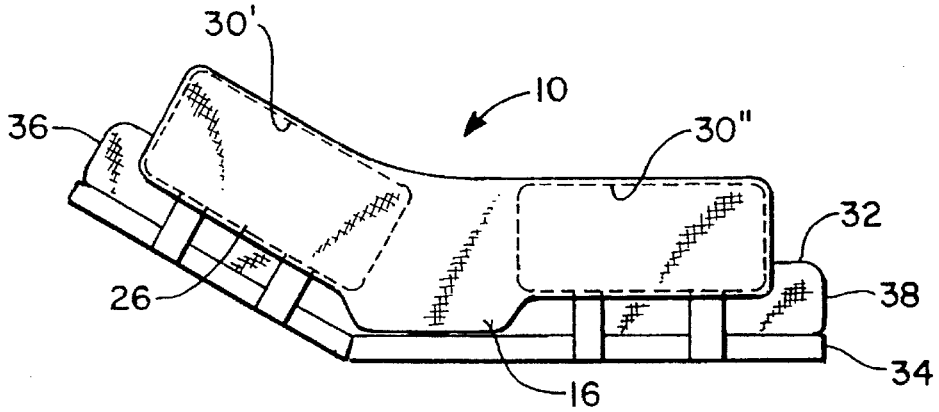
Figure 5C:
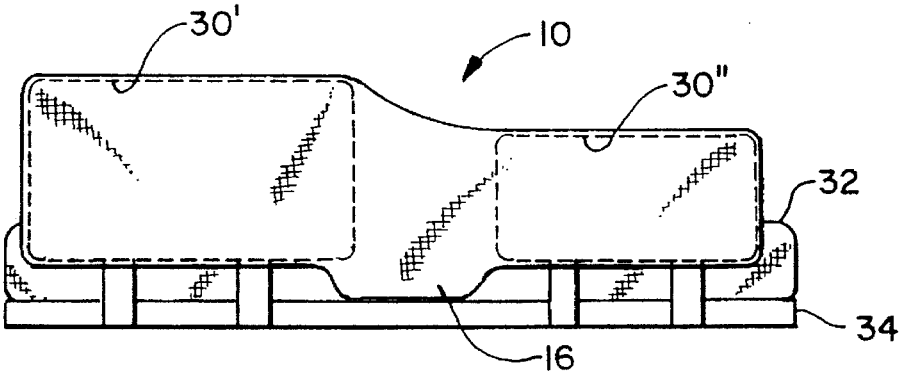

FIGS. 5A, 5B and 5C illustrate how the bed rail apparatus 10 accommodates various mattress 32 configurations. In FIG. 5A, the whole mattress 32 is in a "normal" horizontal position. The bed rail apparatus 10 may be stretched slightly to provide a snug fit and taut appearance. In FIG. 5B, an upper portion of the mattress 36 has been raised to an inclined position relative to a lower portion of the mattress 38. As shown, the bed rail apparatus 10 stretches along the bottom edge 20 to accommodate the motion of bottom of bed rail segment 30+ away from the bottom of bed rail segment 30". In FIG. 5C, bed rail segment 30' has been raised to a higher position than bed rail segment 30". The bed rail apparatus 10 stretches along its length to accommodate the relative motion between the two bed rail segments 30' and 30". The same degree of patient protection is provided for every mattress position.

While preferred embodiments have been shown and described, various modifications and substitutions may be made thereto without departing from the spirit and scope of the invention. Accordingly, it is to be understood that the present invention has been described by way of illustration and not limitation.

I claim:

1. A bed rail apparatus for a bed of a type having a mattress, a mattress support end at least one vertically variably positionable bed rail on at least one of its sides, the bed rail apparatus comprising:

envelope means for defining an envelope having opposed first and second side panels, each said side panels having opposite top and bottom portions and opposite first end second end portions, said envelope meads further comprising closure means for at least partially closing said top portion, said first end portion and said second end portion of said first side panel with said top portion, said first end portion, and said second end portion of said second side panel respectively, said envelope means defining an opening adjacent said bottom portion, said bed rail apparatus being dimensioned to fit over and envelop the bed rail; and means for securing said apparatus to the bed, said means for securing comprising a sheet of elastomeric material having opposite first and second edge portions, said first edge portion being attached to said top portion of said first side panel, said means for securing further comprising a plurality of grommets disposed in said second edge portion and clip means engaging said grommets for securing said second edge portion to the bed.

2. A bed rail apparatus for a bed of a type having a mattress, a mattress support and at least one vertically variably positionable bed rail on at each of its sides, the bed rail apparatus comprising:

envelope means for defining an envelope having opposed first and second side panels, each of said side panels having opposite top and bottom portions and opposite first and second end portions, said envelope means further comprising closure means for at least partially closing said top portion, said first portion, and second end portion of said first side panel with said top portion, said first end portion, and said second end portion of said second side panel respectively, said envelope means defining an opening adjacent said bottom portion, said bed rail apparatus being dimensioned to fit over and envelop the bed rail; end means for securing said apparatus to the bed, said means for securing comprising a sheet of elastomeric material having opposite first and second edge portions, said first edge portion extending from said bottom portion of said first side panel to said bottom portion of said second side panel.

3. The bed rail apparatus of claim 2 further comprising a first border strip having opposite first and second edge portions, said portion of said first border strip being attached to said top portion, said first end portion, and said second end portion of said first side panel, said second edge portion of said first border strip being attached to said top portion, said first end portion, and said second end portion of said second side panel.

4. The bed rail apparatus of claim 3, wherein said side panels and said first border strip are composed of elastomeric material.

5. The bed rail apparatus of claim 3 wherein said first border strip is composed of elastic webbing.

6. The bed rail apparatus of claim 3 further comprising second and third border strips, said second and third border strips being attached to said first and second side panel bottom portions respectively, said second and third border strips being composed of an elastomeric material.

7. The bed rail apparatus of claim 6, wherein said second and third border strips each further comprise first and second end sections and said bed rail apparatus further comprising first and second handle means, said first handle means being attached to said second and third border strip first end sections and said second handle means being attached to said second and third border strip second end sections.

8. The bed rail apparatus of claim 3, wherein said first border strip further comprises first and second end sections and said bed rail apparatus further comprises handle means, said handle means being attached to said first border strip end sections.

9. The bed rail apparatus of claim 2 further comprising first and second envelope means, said envelope means being dimensioned to fit over and envelop the bed rails on opposite sides of the bed, and connector means for connecting said means of securing of said first envelope means to said means of securing of said second envelope means.

10. A bed rail apparatus for a bed of a type having a mattress, a mattress support and a plurality of vertically variably positionable bed rail segments on each side, the bed rail apparatus comprising:

a first border strip having longitudinally extending first and second edge portions, said border strip forming a top portion and first and second end portions, said first border strip being composed of an elastomeric material;

first and second opposed side panels composed of an elastomeric material, each of said side panels having opposite top and bottom portions, and opposite first end and second end portions, said first edge portion of said first border strip being attached to said top portion, said first end portion, and said second end portion of said first side panel, said second edge portion of said first border strip being attached to said top portion, said first end portion, and said second end portion of said second side panel, said first and second side panels defining an opening adjacent said bottom portion and being disposable on either side of the bed rail segment;

means for securing said apparatus to the bed, said means for securing comprising a sheet of resilient material having opposite first and second edge portions, said first edge portion of said means for securing extending from said bottom portion of said first side panel, said second edge portion of said means for securing extending from said bottom portion of said second side panel; and second and third border strips, said second border being attached to said bottom portion of said first side panel, said third border strip being attached to said bottom portion of said second side panel said second and third border strips being composed of an elastomeric material.

11. The bed rail apparatus of claim 10, wherein said first border strip further comprises first and second end sections end said bed rail apparatus further comprises handle means, said handle means being attached to said first border strip and sections.

12. The bed rail apparatus of claim 10, wherein said second and third border strips each further comprise first and second end sections and said bed rail apparatus further comprises first and second handle means, said first handle means being attached to said second and third border strip first end sections and said second handle means being attached to said second and third border strip second end sections.

* * * * *

UNITED STATES PATENT AND TRADEMARK OFFICE

CERTIFICATE OF CORRECTION

PATENT NO. : 5,481,772

DATED : January 9, 1996

INVENTOR(S) : William D. Glynn et al

It is certified that error appears in the above-indentified patent and that said Letters Patent is hereby corrected as shown below:

Column 4, line 50, after "each" insert --of--;
line 52, change "end" (first occurrence) to --and--;
line 52, change "meads" to --means--.

Column 5, line 18, change "end" to --and--;
line 27, before "portion" insert --first edge--.

Column 6, line 37, after "panel" insert --,--;
line 42, change "end" to --and--;
line 44, change "and" to --end--.

Signed and Sealed this

Twelfth Day of November, 1996

*Attest:*

Bruce Lehman

BRUCE LEHMAN

*Attesting Officer*

*Commissioner of Patents and Trademarks*